US005865914A

United States Patent [19]

Karabin et al.

[11] Patent Number: 5,865,914

[45] Date of Patent: Feb. 2, 1999

[54] METHOD FOR MAKING AN AEROSPACE STRUCTURAL MEMBER

[75] Inventors: Lynette M. Karabin, Ruffdale; John Liu, Lower Burrell; Allison S. Warren, Pittsburgh; Gary H. Bray, Murrysville, all of Pa.

[73] Assignee: Aluminum Company of America, Pittsburgh, Pa.

[21] Appl. No.: 909,026

[22] Filed: Aug. 11, 1997

Related U.S. Application Data

[62] Division of Ser. No. 489,193, Jun. 9, 1995.

[51] Int. Cl.[6] ..... C22C 21/00

[52] U.S. Cl. ..... 148/693; 148/692; 148/691; 148/688; 148/437; 148/438; 148/439; 148/440; 420/528; 420/529; 420/533; 420/534

[58] Field of Search ..... 148/693, 692, 148/691, 688, 437, 438, 439, 440; 420/528, 529, 533, 534

[56] References Cited

U.S. PATENT DOCUMENTS 4,336,075 6/1982 Quist et al. ..... 148/2
5,061,327 10/1991 Denzer et al. ..... 148/12.7

*Primary Examiner*—Patrick Ryan
*Assistant Examiner*—M. Alexandra Elve
*Attorney, Agent, or Firm*—Gary P. Topolosky

[57] ABSTRACT

There is claimed a lower wing structure for a commercial jet aircraft which includes a substantially unrecrystallized rolled plate member made from an aluminum alloy consisting essentially of about 3.6 to 4.0 wt. % copper, about 1.0 to 1.6 wt. % magnesium, about 0.3 to 0.7 wt. % manganese, about 0.05 to 0.25 wt. % zirconium, the balance aluminum and incidental elements and impurities. On a preferred basis, the alloy products of this invention include very low levels of both iron and silicon, typically on the order of less than 0.1 wt. % each, and more preferably about 0.05 wt. % or less iron and about 0.03 wt. % or less silicon. This alloy composition may be rolled to form lower wing skin plates and extruded or rolled to form wing box stringers therefrom.

26 Claims, 4 Drawing Sheets

METHOD FOR MAKING AN AEROSPACE STRUCTURAL MEMBER

This application is a division of application Ser. No. 08/489,193 filed Jun. 9, 1995.

This invention pertains to an aluminum alloy lower wing skin used as structural support for the wing box of large commercial aircraft. More specifically, the invention pertains to an aluminum alloy material for use as a lower wing skin structural member.

BACKGROUND OF THE INVENTION

1. Field of the Invention

There are numerous commercial jet aircraft of various sizes including the large "jumbo jet" aircraft, such as the Boeing 747, McDonnell Douglas MD11 and Lockheed L1011. In still larger aircraft, such as the 600 passenger planes envisioned for the future, the loads on wing members needed to hold these aircraft aloft are somewhat heightened. Such large aircraft will carry in the neighborhood of 600 passengers and may include two passenger decks. While a Boeing 747 (one of the largest planes in commercial use) has an empty weight of about 399,000 pounds, it is estimated that future high capacity crafts may weigh as much as 532,000 pounds empty and somewhere around 1,200,000 pounds loaded. As used herein, the term "high capacity aircraft" refers to planes weighing more than 450,000 pounds empty. To heighten the overall efficiency of such aircrafts, it would be important to have materials in the wing structures that can support the load of these airplanes without themselves becoming too heavy. Aluminum alloys have seen wide use in airplane structural members, including airplane wing structural members, and have an enviable record for dependability and performance. More exotic, composite or other materials can be used for airplane wing structural members, but are much more costly and can be somewhat less dependable than aluminum alloys.

2. Technology Review

In general, the structural core of a large airplane wing typically includes a box-like structure made of an upper wing skin, lower wing skin, and end pieces for closing in the ends of this box-like structure. While the upper and lower members are labeled "skin", it is important to appreciate that these are not thin skins such as on the airplane fuselage, but rather thick plate products, for instance one half inch or more. In most of the current commercial jet aircraft, the upper wing skin is made of a 7000 Series alloy, currently a 7X50 alloy (As used herein, "7X50" refers to both 7050 and 7150 aluminum), or the more recently developed aluminum alloy 7055. U.S. Pat. No. 3,881,966 describes 7X50 alloys and U.S. Reissue Pat. No. 34,008 describes the use of 7150 aluminum as upper wing skins on a commercial jet plane. U.S. Pat. No. 5,221,377 describes alloy 7055 and refers to its use in aerospace structural members. Upper wing skins are normally artificially aged to T6-type or possibly T7-type tempers. U.S. Pat. Nos. 4,863,528, 4,832,758, 4,477,292, and 5,108,520 each describe 7000 Series aluminum alloy temperings which can be used to improve the performance of such alloys. All the aforesaid patents (U.S. Pat. Nos. 3,881,966, Re. 34,008, 5,221,377, 4,863,528, 4,832,758, 4,477,292 and 5,108,520) are fully incorporated herein by reference.

In commercial jet aircraft, the lower wing skins have generally been made of aluminum alloy 2024, or similar products such as alloy 2324 which is described in U.S. Pat. No. 4,294,625. The temper normally applied to these 2000 Series alloys is a T3-type, such as T351 or T39. All temper and alloy designations used herein are generally described in the *Aluminum Association Standards and Data* book, the pertinent disclosures of which are incorporated by reference herein.

Both the upper and lower wing skins of these aerospace box-like structures may be reinforced by stringer members having a channel, T- or J-type cross-sectional. Such stringer members are typically riveted to the inner surfaces of a wing skin to stiffen that skin and further stiffen the overall wing box structure. In general, when a commercial jet aircraft is in flight, the upper wing skin of this box is in compression and lower wing skin in tension. An exception occurs when the airplane is on the ground. There, the stresses are reversed but at much lower levels since the wing outboard of a landing gear virtually holds its own weight while on the ground. Thus, the more critical applications exist when an airplane is in flight to place the upper wing skin in compression and lower wing skin in tension.

There have been limited exceptions to the alloy selections for commercial jet planes described above. These include the Lockheed L1011 which used 7075-T76 lower wing skins and stringers and the military KC135 fueler plane which included 7178-T6 lower wing skins and stringers. Another military plane, the C5A, used 7075-T6 lower wing skins that were integrally stiffened by machined out metal. Military fighter planes such as the F4, F5E, F8, F16 and F18 have included lower wing materials of 7075 alloy or related 7475 alloy (F16 and F18). But, generally speaking, wing box structures for commercial jets over the years have included a 7000 Series alloy upper wing skin and lower wing skin made of a 2000 Series alloy, namely, 2024 aluminum or other member of the 2024 family.

The important desired properties for a lower wing skin in high capacity aircraft include higher strength, better fatigue life and improved fracture toughness, especially when compared to today's 2X24 equivalents. Current alloys for lower wing skin members in commercial jet aircraft all lack in the property needs required for tomorrow's high capacity aircraft.

SUMMARY OF THE INVENTION

It is a principal objective of this invention to provide aerospace alloy products having improved combinations of strength, fatigue life and fracture toughness. It is yet another objective to produce an unrecrystallized Al—Cu—Mg—Mn alloy products with enhanced aerospace structural performance. It is another objective to provide a 2000 Series aluminum alloy product which outperforms its 2024 and 2324 alloy counterparts when processed into lower wing skin materials and other wing box structural parts.

These and other advantages of this invention are achieved with a lower wing skin for a commercial jet aircraft comprised of a substantially unrecrystallized rolled plate member made from an aluminum alloy consisting essentially of about 3.6 to 4.2 wt. % copper, about 1.0 to 1.6 wt. % magnesium, about 0.3 to 0.8 wt. % manganese, about 0.05 to 0.25 wt. % zirconium, the balance aluminum and incidental elements and impurities. On a preferred basis, the alloy products of this invention include very low levels of both iron and silicon, typically on the order of less than 0.1 wt. % each, and more preferably about 0.05 wt. % or less iron and about 0.03 wt. % or less silicon. This alloy composition may be rolled to form lower wing skin plates therefrom or extruded to form wing box stringers therefrom. All such products exhibit a combination of properties which render them suitable for use in the wing structure of high capacity aircraft. Plates of the same alloy may also be used to make the long tapered web or spar members at the ends of box-like wing structures for such aircraft. It is also conceivable that extruded plate products, made according to this invention, would be used in the assembly of lower wing skin structures for tomorrow's commercial aircraft.

BRIEF DESCRIPTION OF THE DRAWINGS

Further features, objectives and advantages of the present invention will be made clearer from the following detailed description of preferred embodiments made with reference to the accompanying drawings in which.

DETAILED DESCRIPTION OF PREFERRED EMBODIMENTS

Figure 1:
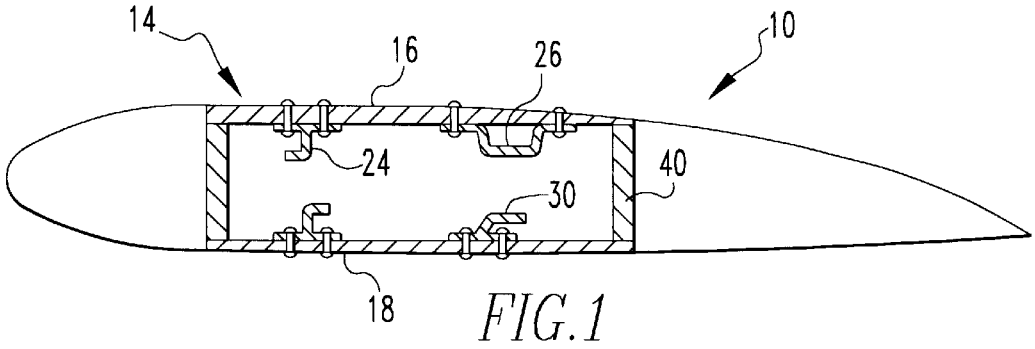
FIG. 1 is a sectional elevation of an airplane wing showing the box-like beam structural members in an exaggerated, schematic sense.

Definitions: For the description of preferred alloy compositions that follows, all percentage references are to weight percents (wt. %) unless otherwise indicated.

The term "ksi" means kilopounds per square inch.

The term "minimum strength" or a minimum for another property or a maximum for a property refers to a level that can be guaranteed and can mean the level at which 99% of the product is expected to conform with 95% confidence using standard statistical methods. And while typical strengths may tend to run a little higher than the minimum guaranteed levels associated with plant production, they at least serve to illustrate an invention's improvement in strength properties when compared to other typical values in the prior art.

The term "ingot-derived" means solidified from liquid metal by a known or subsequently developed casting processes and includes, but is not limited to, direct chill (DC) continuous casting, electromagnetic continuous (EMC) casting and variations thereof, as well as truly continuous cast slab and other ingot casting techniques.

By "substantially unrecrystallized", it is meant that the plate products of this invention are preferably 85 to 100% unrecrystallized, or at least 60% of the entire thickness of said plate products are unrecrystallized.

The term "2XXX" or "2000 Series" when referring to alloys means those structural aluminum alloys with copper as the alloying element present in the greatest weight percent as defined by the Aluminum Association.

When referring to any numerical range of values herein, such ranges are understood to include each and every number, decimal and/or fraction between the stated range minimum and maximum. A range of about 3.6 to 4.2 wt. % copper, for example, would expressly include all intermediate values of about 3.61, 3.62, . . . 3.65, . . . 3.7 wt. % and so on all the way up to and including 4.1, 4.15 and 4.199 wt. % Cu. The same applies to all other elemental ranges, property values (including strength levels) and/or processing conditions (including aging temperatures) set forth herein.

The term "substantially-free" means having no significant amount of that component purposefully added to the composition to import a certain characteristic to that alloy, it being understood that trace amounts of incidental elements and/or impurities may sometimes find their way into a desired end product. For example, a substantially vanadium-free alloy should contain less than about 0.1 or 0.05% V, or more preferably less than about 0.03% V, due to contamination from incidental additives or through contact with certain processing and/or holding equipment. All preferred first embodiments of this invention are substantially vanadium-free. On a preferred basis, these same alloy products are also substantially free of lithium, bismuth, lead, cadmium, chromium, titanium and zinc.

The expression "consisting essentially of" is meant to allow for adding further elements that may even enhance the performance of the invention so long as such additions do not cause the resultant alloy to materially depart from the invention and its minimum properties as described herein and so long as such additions do not embrace prior art.

While significant emphasis is placed on "high capacity" planes as that term has been defined above, they are only a preferred application for this invention and not necessarily the only use therefor. It is believed that various aspects of this invention would also apply to certain military and other commercial jet aircraft.

In FIG. 1, there is shown a rough schematic illustrating the wing 10 for a high capacity aircraft which wing includes a box member 14 comprised of an upper wing skin 16, lower wing skin 18 and end members 20 and 40 for closing the ends to box member 14. Included on the inner surfaces of upper and lower wing skins 16 and 18 are stringers 24, 26 and 30, each stringer being shaped differently in cross-section for illustration purposes. It should be remembered at all times that FIG. 1 is merely a schematic representation of a wing and not a scale or detailed drawing of any commercial jet aircraft component part. The connection between end members 20 and 40, on one hand, and upper and lower wing skins 16 and 18 on the other hand, is shown schematically, there being numerous other known or subsequently developed means for connecting such pieces.

Figure 2:
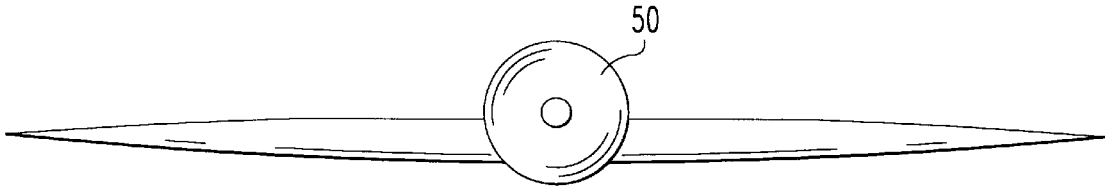
FIG. 2 is an elevational view of the front of an airplane schematically illustrating the curvature of its wings in a somewhat exaggerated sense.

Along various points of the wing's length, it is significant that the thickness of upper wing skin 16 and lower wing skin 18 diminish as one proceeds further out from the central fuselage section, item 50 in FIG. 2. That is, the wing skins are relatively thicker closer to fuselage 50 and thin as one goes out closer to the wing tips. In addition, the upper wing skin 16 and lower wing skin 18 actually curve going from the plane's hull to its outer wing tips. Such a structure enhances strength and illustrates some of the forming typically applied to these upper and lower wing skin members.

Figure 3:
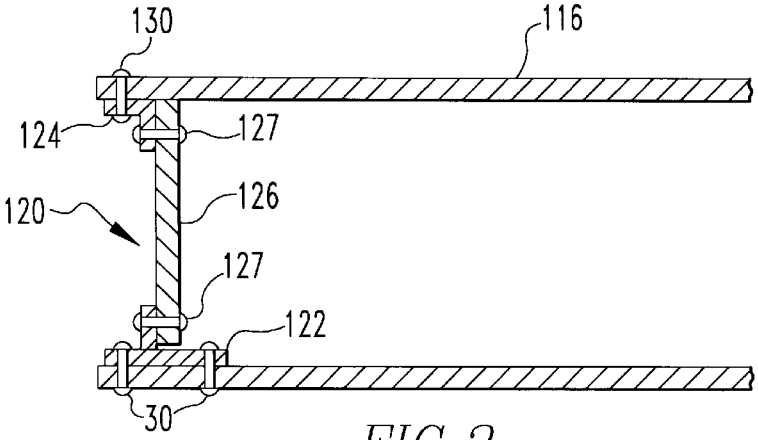
FIG. 3 is another sectional elevation of a portion of the box-like wing beam structure showing different spar arrangements.

Referring to FIG. 3, upper wing skin 116 and lower wing skin 118 are connected by end spar member 120 to form a rigid box-like structure. One way to assemble such a structure is illustrated in the left-hand side of FIG. 3. There, web or plate-like member 126 is joined to stringer upper "L" member 124 or lower "T" member 122 by rivets 127. They, in turn, are joined to adjacent skin members by rivets 130.

In accordance with this invention, the upper wing skins of these box-like structures may be made of one or more alloys described earlier herein. Preferably, an upper wing skin made from 7055 aluminum consists essentially of about 7.6 to about 8.4% zinc, about 1.8 to 2 or possibly 2.1% magnesium, about 2.1 to 2.6% copper, and about 0.03 to about 0.3% zirconium, the balance substantially aluminum incidental elements and impurities. The lower wing skin and webs for that assembly are preferably substantially unrecrystallized, rolled plate products made from an aluminum alloy consisting essentially of, broadly speaking, about 3.6 to 4.2 wt. % copper, about 1.0 to 1.6 wt. % magnesium, about 0.3 to 0.8 wt. % manganese, and about 0.05 to 0.25 wt. % zirconium, the balance substantially aluminum, incidental elements and impurities. For stringers, preferably substantially unrecrystallized extruded products are made from the same alloy. On a preferred basis, this invention includes very low levels of both iron and silicon, typically on the order of about 0.1 wt. % or less of each element, and more preferably about 0.05 wt. % or less iron and about 0.03 wt. % or less silicon. On a more preferred basis, the unrecrystallized aerospace plate products of this invention include total copper contents ranging from a lower limit of about 3.7 or 3.8 wt. %, to an upper limit of about 4.0 or 4.1 wt. %. Preferred magnesium contents range from about 1.15 to 1.5 wt. % and total manganese contents preferably vary between about 0.5 and 0.6 wt. %. As for the zirconium content of this invention, preferred levels range from about 0.09 to 0.13 wt. %.

In accordance with the invention, the preferred alloy is made into an ingot-derived product suitable for hot working or rolling. For instance, large ingots of the aforesaid composition can be semicontinuously cast, then scalped or machined to remove surface imperfections as needed or required to provide a good rolling surface. Of course, it would be preferred to cast ingots of such surface quality that scalping or machining would not be required, but in many cases it is preferred and even recommended to scalp an ingot before hot rolling. The ingot may then be preheated to homogenize and solutionize its interior structure. A suitable preheat treatment is to heat the ingot to about 880° or 900° F. It is preferred that homogenization of this invention be conducted at cumulative hold times on the order of about 12 to 24 hours.

The ingot is then hot rolled to achieve a desired, substantially unrecrystallized grain structure. Hence, hot rolling should be initiated when the ingot is at a temperature substantially above about 750° F., for instance around 800° or 850° F. This increases the likelihood of avoiding recrystallization in the rolled product produced thereby. For some products, it is preferred to conduct such rolling without reheating, i.e., using the power of the rolling mill to maintain rolling temperatures above a desired minimum. Hot rolling is then continued, normally in a reversing hot mill, until the desired thickness of end plate product is achieved.

In accordance with this invention, the desired thicknesses of hot rolled plate for lower wing skin applications are generally between about 0.35 to 2.2 inches or so, and preferably within about 0.9 to 2 inches.

In addition to the preferred embodiments of this invention for lower wing skin and spar webs, other applications of this alloy may include stringer extrusions. When making an extrusion, the invention alloy is first heated to between about 650°–800° F., preferably to about 750° F., and includes a reduction in cross-sectional area (or extrusion ratio) of at least about 10:1.

Hot rolled plate or other wrought product forms of this invention are preferably solution heat treated (SHT) at one or more temperatures between about 900° to 935° F. to take substantial portions, preferably all or substantially all, of the soluble magnesium and copper into solution, it being again understood that with physical processes which are not always perfect, probably every last vestige of these main alloying ingredients may not be fully dissolved during the SHT (or solutionizing) step(s). After heating to the elevated temperatures described above, the plate product of this invention should be rapidly cooled or quenched to complete solution heat treating. Such cooling is typically accomplished by immersion in a suitably sized tank of cold water or using water sprays, although air chilling may be used as supplementary or substitute cooling means.

After quenching, this product is both cold worked and stretched to develop adequate strength, relieve internal stresses and straighten the product. Increasing the strength through strain hardening, e.g., cold working, is more attractive than increasing strength by precipitation hardening for Al—Cu—Mg alloys since the latter severely degrades fracture toughness.

For plate products from this invention, the natural aging interval between quenching and cold rolling should preferably be carefully controlled. If the interval is too short, strengths will be reduced and may even be too low. As natural aging proceeds, strength increases and toughness drops. Upon further aging, the strength continues to increase without further losses in toughness. Therefore, the natural aging interval should be as long as practical, preferably controlling it to be within 4 and 30 hours. Rolling reductions greater than about 9% at room temperature, or an amount equivalent to that provided by rolling at other temperatures, are needed to develop sufficient strength.

The natural aging interval after cold rolling is also important for the development of optimal properties in plate products. This interval helps in improving the overall toughness levels, with possible improvements in strength as well. A minimum 18 hours, and preferably up to 72 hours of natural aging, prior to final stretch is recommended for reproducible attractive strength-toughness combinations.

Product Properties

Figure 4:
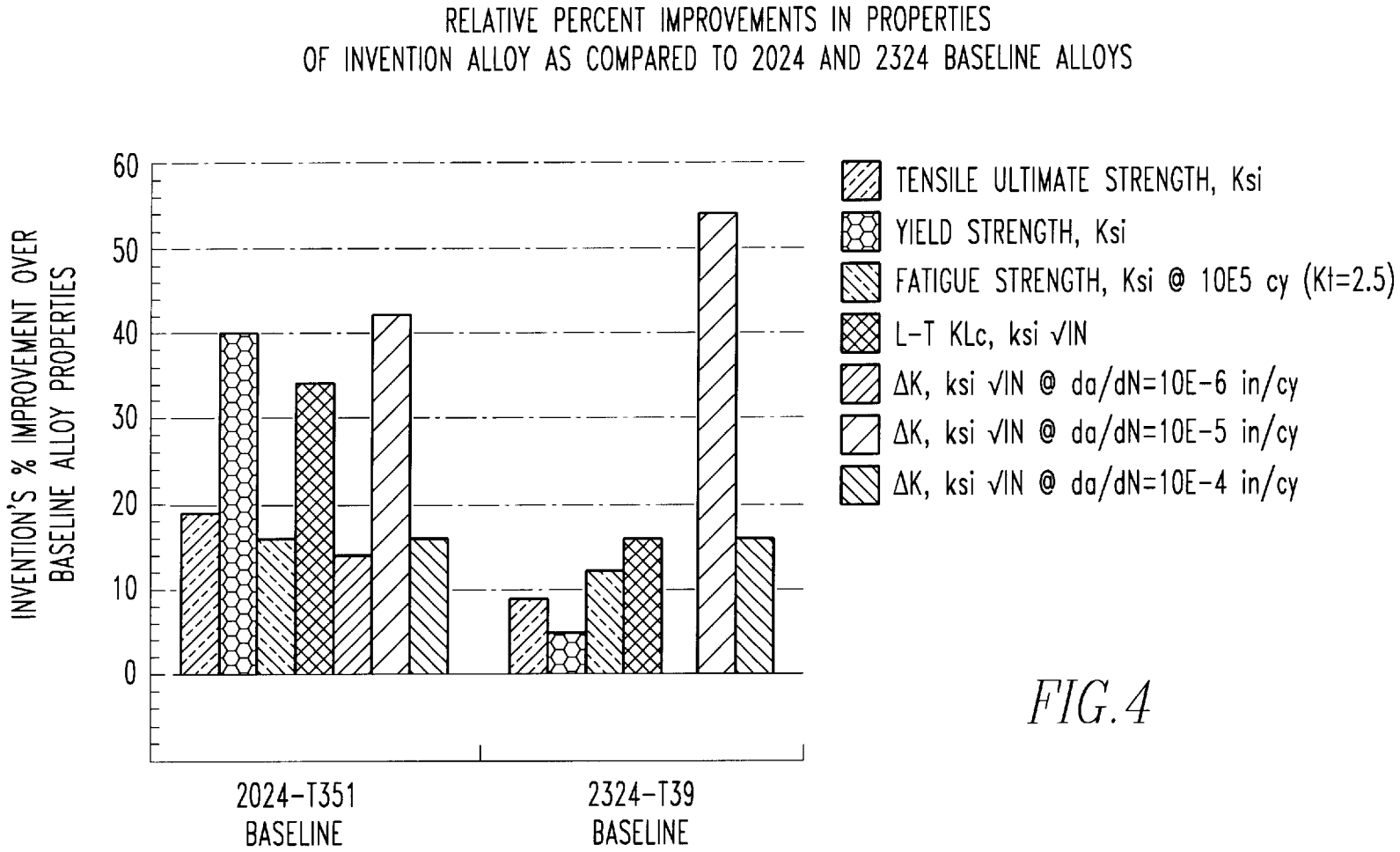
FIG. 4 is a graph comparing the percent improvement of the invention alloy versus alloy 2024-T351 and 2324-T39 for certain key properties.

Important properties required for the design of lower wing skins for commercial transport planes are tensile strength, fracture toughness, fatigue and fatigue crack growth rate. The invention alloy represents an improvement over both 2024-T351 and 2324-T39 for all of these properties. These advantages are summarized in accompanying Table 1. The relative property improvements of the invention alloy with respect to existing alloys for the same applications, both 2024-T351 and 2324-T39, are presented in accompanying FIG. 4. These property advantages are believed to be due to the carefully selected composition, the carefully controlled thermomechanical processing imparted thereto and its unrecrystallized grain structure.

Fracture toughness is an important property to airframe designers, particularly when good toughness can be combined with good strength. When the geometry of a structural component is such that it does not deform plastically through its thickness when a tensile load is applied (plane-strain deformation), fracture toughness can be measured as plane-strain fracture toughness, or $K_{Ic}$. This normally applies to relatively thicker product section, for instance, preferably about 0.8 or 1 inch thick or more. The ASTM has established a standard test using a fatigue pre-cracked compact tension specimen to measure $K_{Ic}$ which has units of ksi√in. This test is usually used to measure fracture toughness when a thick specimen of material is available because it is believed to be independent of specimen geometry as long as appropriate standards for width, crack length and thickness are met.

The toughness of products made by the present invention is very high and, in some cases, may allow aircraft designers to focus on the material's durability and damage tolerance to emphasize fatigue resistance as well as notch toughness. Resistance to cracking by repeated fatigue loading is very desirable. Such fatigue cracking occurs as a result of repeated loading and unloading cycles, or cycling between high and low loads such as when a wing moves up and down. Such cycling in load can occur during flight due to wind gusts or other sudden changes in air pressure, or even on the ground while the plane taxis on a runway. Fatigue failures account for a large percentage of failures in aircraft components. Such failures are insidious because they can occur under normal operating conditions without excessive overloads, and without warning. And crack evolution is known to accelerate because inhomogeneities in a material act as sites for the initiation and/or facilitating link of smaller cracks. Therefore, process or compositional changes which improve metal quality by reducing the severity or number of harmful inhomogeneities improve fatigue durability.

Figure 5:
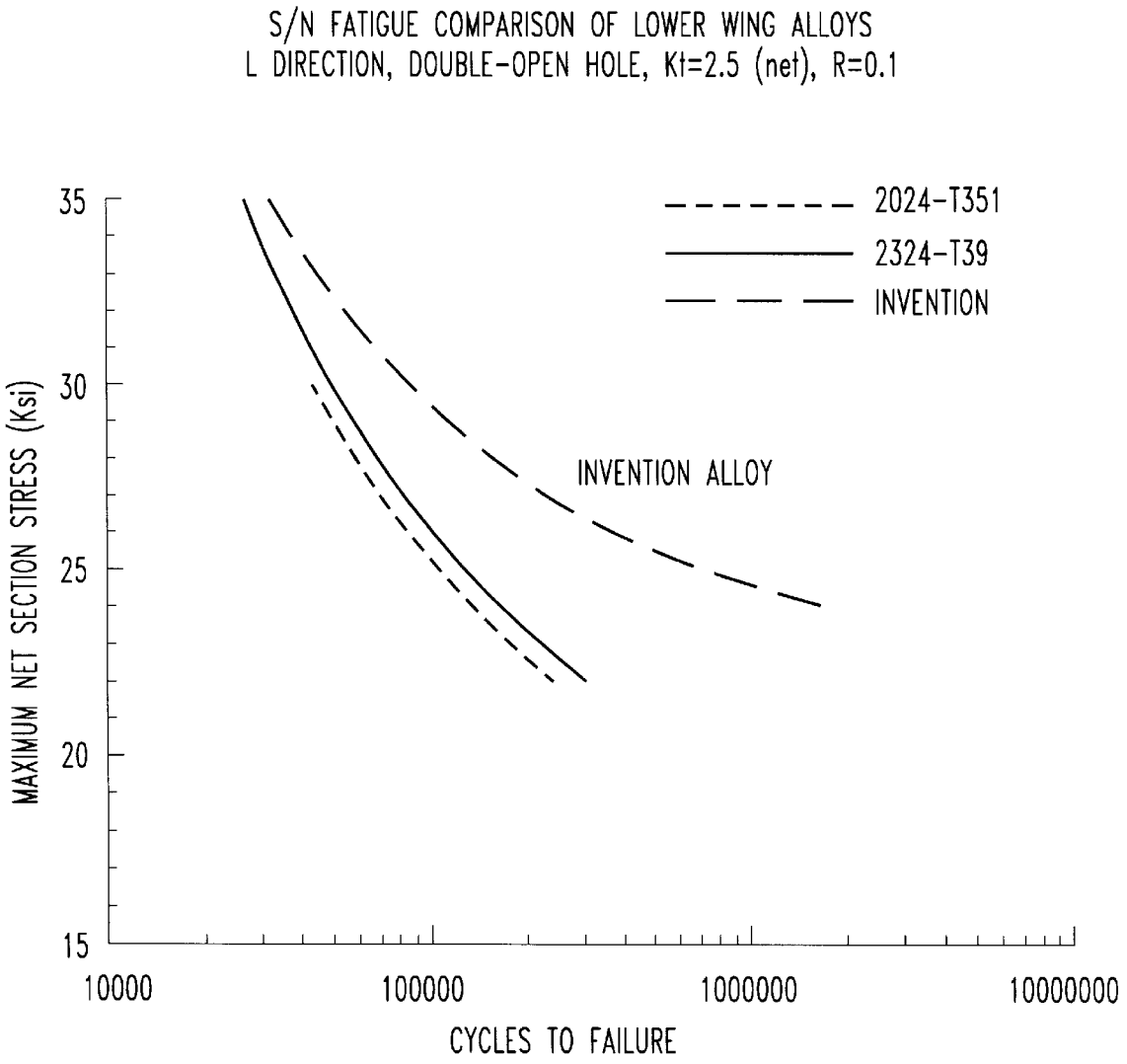
FIG. 5 is a graph comparing the S/N fatigue values of the invention alloy versus comparable parts made from 2024-T351 and 2324-T39 aluminum.

Stress life (S-N) fatigue tests characterize material resistance to fatigue initiation and small crack growth which comprise a major portion of total fatigue life. Hence, improvements in S-N fatigue properties may enable a component to operate at higher stresses over its design life, or at the same stress for an increased life. The former translates into significant weight savings by downsizing, or in cost savings through component or structural simplification, while the latter into fewer inspections and lower support costs. Such fatigue loads are below static ultimate tensile strength of the material measured in a tensile test, and they are typically below the material's yield strength. Fatigue initiation tests are important indicators for buried or hidden structural members which are not readily accessible for visual or other examination to inspect for cracks or crack starts. In this type of S-N fatigue testing, at a net stress concentration factor $K_t$ of 2.5 (using specimens about 9"×1"×⅛" with two holes 0.187 inch diameter along the length pulled axially) and a minimum/maximum stress ratio R of 0.1, the invention demonstrates a marked improvement over 2024-t351 and 2324-T39 as shown in FIG. 5.

If a crack or crack-like defect exists, repeated cyclic or fatigue loading can cause that crack to grow in a structure. This is referred to as fatigue crack growth or propagation. Propagation of a crack by fatigue may lead to a crack large enough to propagate catastrophically when the combination of crack size and loads are sufficient to exceed that material's fracture toughness. Thus, an increase in the resistance of a material to crack propagation by fatigue offers substantial benefits to aerostructure longevity. The slower a crack propagates, the better. A rapidly propagating crack in an airplane structural member can lead to catastrophic failure without adequate time for detection, whereas a slowly propagating crack allows time for detection and corrective action or repair. Hence, a low fatigue crack growth rate is a desirable property.

The rate at which a crack in a material propagates during cyclic loading is influenced by the initial length of the crack. Another important factor is the difference in maximum and minimum loads between which the structure is cycled. One quantitative measurement for taking into account the effects of crack length and difference between maximum and minimum loads is called the cyclic stress intensity factor range or ΔK, having units of ksi√in, similar to the stress intensity factor for measuring fracture toughness. The stress intensity factor range (ΔK) is the difference between stress intensity factors at maximum and minimum loads. Another measure affecting fatigue crack propagation is the ratio between the minimum and the maximum loads during cycling. This is called the stress ratio and denoted by R, with a ratio of 0.1 meaning that the maximum load is 10 times the minimum load. The stress, or load, ratio may be positive, negative or zero. Fatigue crack growth rate testing is typically done in accordance with ASTM E647-88 and other related specifications which are well known in the art, the contents of which are incorporated by reference herein.

The fatigue crack propagation rate can be measured for a material using a specified test coupon having a crack. One such test specimen is about 12 inches long by 4 inches wide and has a notch in its center extending cross-wise normal to its length. This notch is about 0.032 inch wide and about 0.2 inch long including a 60° bevel at each end. The test coupon is subjected to cyclic loading which causes the crack to grow at the ends of the notch. After the crack reaches a predetermined length the crack length gets measured periodically. A crack growth rate can then be calculated for the given increment of crack extension by dividing the change in crack length (called Δa) by the number of loading cycles (ΔN) which produced that amount of crack growth. The crack propagation rate is represented by Δa/ΔN or 'da/dN' and has units of inches/cycle. The fatigue crack propagation rates of a material can be determined from a center cracked tension panel. In a comparison using R=0.1 tested at a relative humidity over 90% with ΔK ranging from around 4 to 20 or 30, the invention material exhibited relatively good resistance to fatigue crack growth (FCG) rate compared to both 2024-t351 and 2324-T39, as shown in Table 1.

The following Table 1 lists minimum tensile properties and typical S/N fatigue, fracture toughness and fatigue crack growth properties for the invention alloy as compared to a 2024-t351 and 2324-T39 part.

TABLE 1

Lower Wing Plate Properties

| Property | 2024-T351 | 2324-T39 | Invention |
|---|---|---|---|
| L-Tensile Ultimate Strength, ksi | 62 | 68 | 74 |
| L-Tensile Yield Strength, ksi | 47 | 63 | 66 |
| L-S/N Fatigue, $K_t$ = 2.5, R = 0.1, Smax (net), ksi @ $10^5$ cycles | 25 | 26 | 29 |
| L-T Fracture Toughness, $K_{IC}$, ksi√in | 32 | 37 | 43 |
| L-T Fatigue Crack Growth, R = 0.1 | | | |
| ΔK, ksi√in @ da/dN = $10^{-6}$ in./cycle | 7 | 8 | 8 |
| ΔK, ksi√in @ da/dN = $10^{-5}$ in./cycle | 12 | 13 | 17 |
| ΔK, ksi√in @ da/dN = $10^{-4}$ in./cycle | 25 | 25 | 29 |

The above discussion and the Table of properties clearly demonstrates the attractiveness of the invention alloy for many aerospace applications. To further evaluate the performance of the invention alloy, the spectrum fatigue crack growth test was performed. The specimen geometry simulates a rivet hole, which invariably has some level of flaws due to machining or assembly. The test specimen was then subjected to the MiniTWIST spectrum, which simulates the stresses that a commercial aircraft wing would experience during flight.

Figure 6:
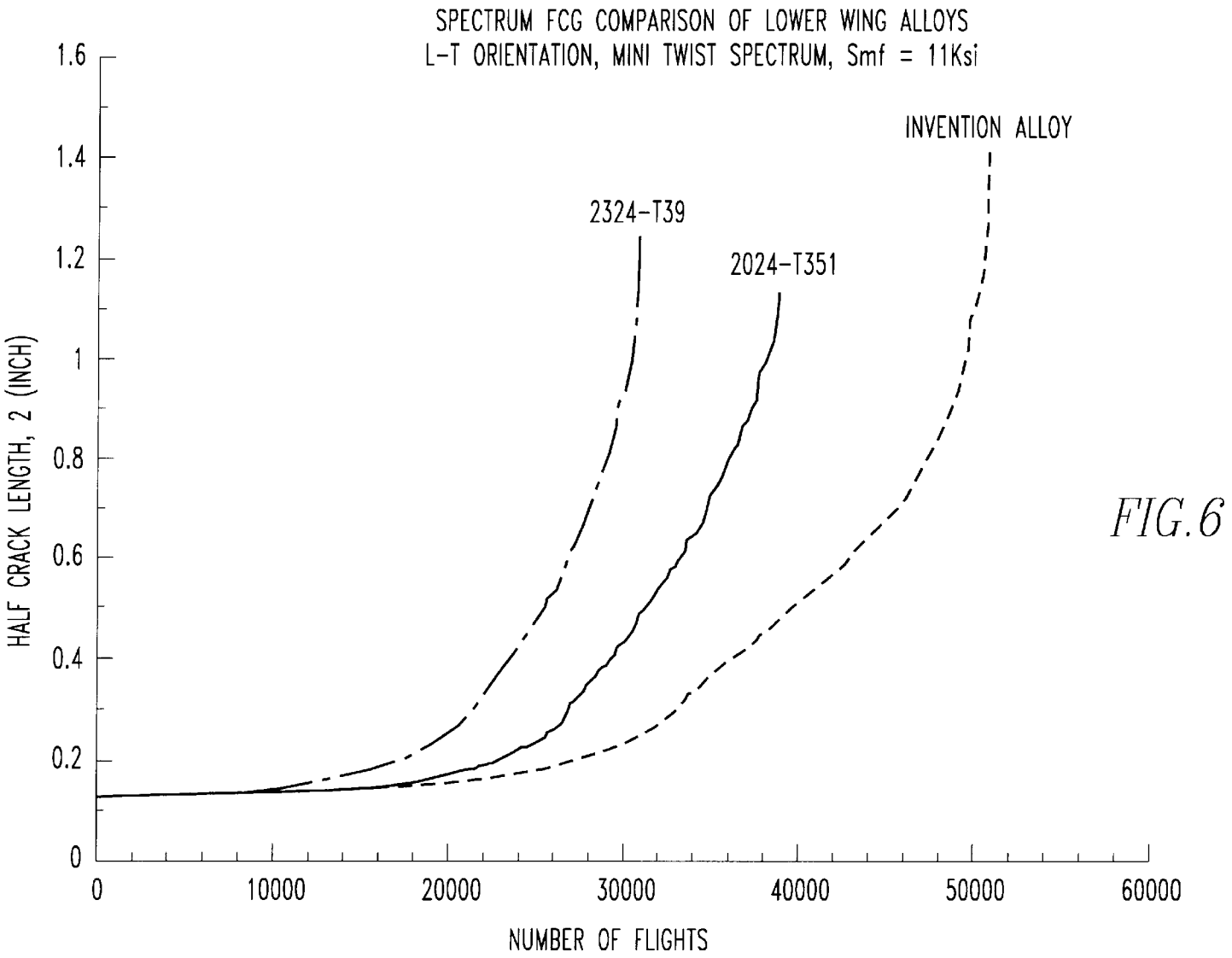
FIG. 6 is a graph comparing the MiniTWIST spectrum fatigue crack growth (FCG) data of the invention alloy versus 2024-T351 and 2324-T39 specimens.

The spectrum fatigue tests were performed for baseline alloys 2024-t351, 2324-T39 and the invention alloy using a modified M(T) specimen 0.3 in. thick, 4 in. wide and 15 in. long with a 0.25 in. diameter hole. A corner flaw of 0.05 in. radius was machined on each side of the hole from which the crack propagated under fatigue loading conditions. The MiniTWIST spectrum was truncated at Level III, and had a mean flight stress of 11 ksi. The half crack length versus the number of flights are plotted in FIG. 6, which clearly shows that a crack from a hole in the invention alloy grows significantly slower than the baseline alloys 2024-t351 and 2324-T39 alloys.

To this point, the emphasis of this invention has been on rolled plate products for the wing skin of a large or "high capacity" airplane, said wing skin being typically about ¼ to 1½ inches thick from one end to another, the production of which would start with an aluminum alloy plate having a length of about 100 to 150 feet, a width of about 80 to 120 inches, and a thickness of about ¾ to 1¾ inches. Referring again to FIG. 1, such a wing skin can be stiffened with stringers which can be J-shaped, such as stringer 25, Z-shaped, like stringer 30, or hat or channel-shaped, such as 26. Any other shape that can be attached to a wing skin 18 for reinforcement purposes without adding significant weight to the structure is also anticipated. While this invention has been described in terms of plate which is preferred, it is believed that other product forms, such as extrusions may enjoy many of the same benefits summarized above.

EXAMPLES

An ingot about 16 inches by 50 inches in cross section, and about 180 inches in length was cast having the following composition:

TABLE 2

Composition of Invention Alloy

| Invention Alloy | | | | | | |
|---|---|---|---|---|---|---|
| Cu (wt. %) | Mg (wt. %) | Mn (wt. %) | Zr (wt. %) | Fe (wt. %) | Si (wt. %) | Ti (wt. %) |
| 3.87 | 1.30 | 0.6 | 0.10 | 0.02 | 0.03 | 0.002 |

This ingot was scalped for hot rolling, then preheated to homogenize the metal and prepare it for hot rolling. The homogenization included heating to about 880° F. and holding there for 12 hours. The resulting material was hot rolled at relatively high temperatures to produce plate about 1.35 inches thick. The high rolling temperatures described herein favor an unrecrystallized condition in the plate after subsequent heat treatment. During plastic deformation, such as rolling, some energy is stored in the deformed metal. Some nucleation and growth of new grains may also take place during hot rolling, subsequent annealing, or during solution heat treating at the expense of a deformed matrix. These nuclei are strain-free and completely or partially surrounded by high-angle grain boundaries. They can grow by the migration of their boundaries into a deformed matrix. If they completely consume this deformed matrix, the metal is said to have been 100% recrystallized and the grain boundaries of this product will possess high angle characteristics. On the other hand, if the growth of new grains is completely inhibited during subsequent thermal processing, the material is said to be 100% unrecrystallized.

The desirable "unrecrystallized" grain structure is promoted by keeping the stored energy of deformation low or minimal through use of a high hot rolling temperature, preferably above about 750° or 800° F. Further, the homogenization treatments described earlier are also believed to cause precipitation of a fine distribution of dispersoids. These dispersoids pin the migrating grain boundaries during annealing or solution heat treating, and help promote an unrecrystallized grain structure. The plate was then solution heat treated to about 925° F. for about 2 hours, after which the hot plate was immersed in a cold water quench. This plate was then naturally aged for 15 hours, cold rolled 11% to develop strength and stretched approximately 1% more than 72 hours later to relieve internal stresses and flatten the plate.

The tensile properties of the invention alloy are listed in following Table 3. Each value in the table represents an average of 12 tests. Tests were performed at t/2 locations using 0.5 inch diameter test specimens.

TABLE 3

Tensile testing of Invention Alloy

| Temper: | T39 |
|---|---|
| L T.Y.S. (ksi) | 72.5 |
| L U.T.S. (ksi) | 78.2 |
| L Elong. (%) | 9.0 |
| L-T T.Y.S. (ksi) | 66.1 |
| L-T U.T.S. (ksi) | 77.7 |
| L-T Elong. (%) | 10.5 |

To manufacture the lower wing skin for commercial jet aircraft, such plate products are cut and/or machined into a desired shape. Normally, a wing skin is tapered to be thicker at the end closer to the fuselage than at the end further away from the fuselage. Such tapering is typically accomplished by machining. Extruded or rolled stringers are then attached to thinner surfaces of these wing skins. If the wing skin itself is bowed, the stringers should also be correspondingly bowed before being joined to the plate. Typically, such stringers are affixed to the plate by mechanical fasteners, normally rivets.

It is preferred that lower wing skin plate be made from an alloy in accordance with the invention and that any stringers also be made with the same alloy. The skins for the upper and lower wing box members are then assembled with the end pieces 20 and 40 in FIG. 1 to make a box-like member as shown in FIG. 1. Fuel tank or other provisions can then be placed inside this wing box structure. In some cases, it may be advantageous to clad plate or sheet in accordance with the invention to enhance some corrosion resistance aspects thereof.

Having described the presently preferred embodiments, it is to be understood that the invention may be otherwise embodied within the scope of the appended claims.

What is claimed is:

1. A method of producing a lower wing skin structural member for a commercial jet aircraft, said lower wing skin structural member having a long transverse yield strength of at least about 60 ksi, said method comprising:

providing a body of alloy consisting essentially of about 3.6 to 4.0 wt. % copper about 1.0 to 1.6 wt. % magnesium, about 0.3 to 0.7 wt. % manganese, about 0.05 to about 0.25% zirconium, not more than about 0.1% silicon and not more than about 0.1% iron, the balance substantially aluminum, incidental elements and impurities;

homogenizing said alloy by heating from about 880° to 900° F.;

hot working said alloy at temperatures above about 750° F.;

solution heat treating said alloy at temperatures of at least about 910° F.; and quenching said alloy before making a structural member therefrom.

2. The method of claim 1 which is used to make a lower wing skin structural member from hot rolled plate, said method further including the steps of: cold working said alloy by at least about 9%; and stretching said alloy by at least about 1% after quenching, said plate having a longitudinal yield strength of at least about 63 ksi, a long transverse yield strength of at least about 57 ksi, and a long transverse fracture toughness $K_{Ic}$ at RT of at least about 38 ksi√in.

3. The method of claim 1 which is used to make a lower wing skin structural member from an extrusion.

4. The method of claim 1 wherein said alloy contains about 1.15 to 1.5 wt. % magnesium.

5. The method of claim 1 wherein said alloy contains about 0.5 to 0.6 wt. % manganese.

6. The method of claim 1 wherein said alloy contains about 0.09 to about 0.13% zirconium.

7. A method of producing a lower wing skin structural member for a commercial jet aircraft, said lower wing skin structural member having a long transverse yield strength of at least about 60 ksi, said method comprising:

providing a body of alloy consisting essentially of about 3.6 to 4.0 wt. % copper, about 1.0 to 1.6 wt. % magnesium, about 0.3 to 0.7 wt. % manganese, about 0.05 to about 0.25% zirconium, not more than about 0.1% silicon and not more than about 0.1% iron, the balance substantially aluminum, incidental elements and impurities;

homogenizing said alloy by heating from about 880° to 900° F.;

hot working said alloy at temperatures above about 750° F.;

solution heat treating said alloy at temperatures of at least about 910° F.;

quenching said alloy;

cold working said alloy by at least about 9%; and stretching said alloy by at least about 1%.

8. The method of claim 7 which produces a hot rolled plate wherein said plate, before or after any shaping, has a longitudinal yield strength of at least about 63 ksi, a long transverse yield strength of at least about 57 ksi, and a long transverse fracture toughness $K_{Ic}$ at RT of at least about 38 ksi√in.

9. The method of claim 7 wherein said alloy contains about 1.15 to 1.5 wt. % magnesium.

10. The method of claim 7 wherein said alloy contains about 0.5 to 0.6 wt. % manganese.

11. The method of claim 7 wherein said alloy contains about 0.09 to about 0.13% zirconium.

12. A method of producing a lower wing skin structural member for a commercial jet aircraft, said lower wing skin structural member having a long transverse yield strength of at least about 60 ksi, said method comprising:

providing a body of alloy consisting essentially of about 3.6 to 4.0 wt. % copper, about 1.0 to 1.6 wt. % magnesium, about 0.3 to 0.7 wt. % manganese, about 0.05 to about 0.25% zirconium, not more than about 0.1% silicon and not more than about 0.1% iron, the balance substantially aluminum, incidental elements and impurities;

homogenizing said alloy by heating from about 880° to 900° F.;

hot rolling said alloy at temperatures above about 750° F.;

solution heat treating said alloy at temperatures of at least about 910° F.;

quenching said alloy;

working said alloy to effect an equivalent to cold rolling said alloy by about 9% or more; and stretching said alloy by at least about 1%.

13. The method of claim 12 which produces a hot rolled plate wherein said plate, before or after any shaping, has a longitudinal yield strength of at least about 63 ksi, a long transverse yield strength of at least about 57 ksi, and a long transverse fracture toughness $K_{Ic}$ at RT of at least about 38 ksi√in.

14. The method of claim 12 wherein said alloy contains about 1.15 to 1.5 wt. % magnesium.

15. The method of claim 12 wherein said alloy contains about 0.5 to 0.6 wt. % manganese.

16. The method of claim 12 wherein said alloy contains about 0.09 to about 0.13% zirconium.

17. A method of producing rolled plate for making a wing spar of a commercial jet aircraft therefrom, said rolled plate having a long transverse yield strength of at least about 60 ksi, said method comprising:

providing a body of alloy consisting essentially of about 3.6 to 4.0 wt. % copper, about 1.0 to 1.6 wt. % magnesium, about 0.3 to 0.7 wt. % manganese, about 0.05 to about 0.25% zirconium, not more than about 0.05% silicon and not more than about 0.07% iron, the balance substantially aluminum, incidental elements and impurities;

homogenizing said alloy by heating within about 880°–900° F.;

hot rolling said alloy at temperatures above about 750° F.;

solution heat treating said alloy at a temperature of at least about 910° F.;

quenching said alloy;

cold rolling said alloy by at least about 9%; and stretching said alloy by about 1% or more.

18. The method of claim 17 wherein said alloy contains about 1.15 to 1.5 wt. % magnesium.

19. The method of claim 17 wherein said alloy contains about 0.5 to 0.6 wt. % manganese.

20. The method of claim 17 wherein said alloy contains about 0.09 to about 0.13% zirconium.

21. A method of producing a structural member for a commercial jet aircraft comprising providing a body of alloy consisting essentially of about 3.7 to 4.1 wt. % copper, about 1.15 to 1.5 wt. % magnesium, about 0.5 to 0.6 wt. % manganese, about 0.09 to about 0.13% zirconium, not more than about 0.05% silicon and not more than about 0.07% iron, the balance substantially aluminum, incidental elements and impurities;

homogenizing said alloy by heating within about 880° to 900° F.;

hot working said alloy;

solution heat treating said alloy at a temperature of at least 910° F.;

quenching said alloy;

cold rolling said alloy by at least about 9%; and stretching said alloy by about 1% or more.

22. A method of producing a structural member for a commercial jet aircraft comprising:

providing a body of alloy consisting essentially of about 3.6 to 4.0 wt. % copper, about 1.0 to 1.6 wt. % magnesium, about 0.3 to 0.7 wt. % manganese, about 0.05 to about 0.25% zirconium, not more than about 0.05% silicon and not more than about 0.07% iron, the balance substantially aluminum, incidental elements and impurities;

homogenizing said alloy;

hot rolling said alloy into a plate;

solution heat treating the plate;

quenching the plate;

cold rolling the plate by at least, about 9%; and stretching the plate by at least about 1%, said plate being substantially unrecrystallized and having a longitudinal yield strength of at least about 63 ksi, a long transverse yield strength of at least about 60 ksi, a short transverse yield strength of at least about 55 ksi, and a long transverse fracture toughness $K_{Ic}$ at RT of at least about 38 ksi√in.

23. The method of claim 22 wherein said alloy contains about 1.15 to 1.5 wt. % magnesium.

24. The method of claim 22 wherein said alloy contains about 0.5 to 0.6 wt. % manganese.

25. The method of claim 22 wherein said alloy contains about 0.09 to about 0.13% zirconium.

26. A method of producing a structural member for a commercial jet aircraft comprising:

providing a body of alloy consisting essentially of about 3.7 to 4.0 wt. % copper, about 1.15 to 1.5 wt. % magnesium, about 0.5 to 0.6 wt. % manganese, about 0.09 to about 0.13% zirconium, not more than about 0.05% silicon and not more than about 0.07% iron, the balance substantially aluminum, incidental elements and impurities;

homogenizing said alloy;

hot rolling said alloy into a plate;

solution heat treating the plate;

quenching the plate;

cold rolling the plate by at least about 9%; and stretching the plate by at least about 1%, said plate being substantially unrecrystallized and having a longitudinal yield strength of at least about 63 ksi, a long transverse yield strength of at least about 60 ksi, a short transverse yield strength of at least about 55 ksi, and a long transverse fracture toughness $K_{Ic}$ at RT of at least about 38 ksi√in.

* * * * *